US009217322B2

(12) United States Patent
Kleppa

(10) Patent No.: US 9,217,322 B2
(45) Date of Patent: Dec. 22, 2015

(54) METHODS FOR INSTALLING AND RETRIEVING A WELL MONITORING APPARATUS

(75) Inventor: Erling Kleppa, Jørpeland (NO)

(73) Assignee: Petroleum Technology Company AS, Stavanger (NO)

( * ) Notice: Subject to any disclaimer, the term of this patent is extended or adjusted under 35 U.S.C. 154(b) by 0 days.

(21) Appl. No.: 13/519,139

(22) PCT Filed: May 16, 2012

(86) PCT No.: PCT/EP2012/059146

§ 371 (c)(1),
(2), (4) Date: Aug. 16, 2012

(87) PCT Pub. No.: WO2013/056859

PCT Pub. Date: Apr. 25, 2013

(65) Prior Publication Data

US 2014/0216757 A1 Aug. 7, 2014

(30) Foreign Application Priority Data

Oct. 21, 2011 (NO) ..... 20111436

(51) Int. Cl.
*E21B 19/00* (2006.01)
*E21B 47/06* (2012.01)
(Continued)

(52) U.S. Cl.
CPC ..... *E21B 47/06* (2013.01); *E21B 33/0355* (2013.01); *E21B 47/00* (2013.01); *E21B 47/0001* (2013.01)

(58) Field of Classification Search
CPC ..... E21B 23/14; E21B 33/04; E21B 17/026; E21B 17/025; E21B 17/023; E21B 47/011; E21B 47/0006; E21B 47/1025; E21B 49/006; E21B 47/00; E21B 47/061; E21B 33/0355; E21B 47/0001
USPC ..... 166/377, 379, 384
See application file for complete search history.

(56) References Cited

U.S. PATENT DOCUMENTS 3,100,023 A * 8/1963 Clements ..... 73/290 V
3,492,866 A * 2/1970 Ratliff et al. ..... 73/152.54
(Continued)

FOREIGN PATENT DOCUMENTS

GB 2286682 8/1995
GB 2377239 A 1/2003
(Continued)

OTHER PUBLICATIONS

Norwegian Search Report (submitted inter alia as statement of relevance for NO20081110).

*Primary Examiner* — Kenneth L Thompson
*Assistant Examiner* — Michael Wills, III
(74) *Attorney, Agent, or Firm* — Christian Abel

(57) ABSTRACT

A method for installing an apparatus for monitoring physical parameters in an annulus of an oil and/or gas well having a well head. The apparatus comprises a sensor plug including a sensor and a flange assembly arranged with a bore holding a signal processing unit for communication with the sensor. The method comprises installing the sensor plug in a passage in the well head, connecting a cable connector to the sensor plug, positioning the bore of the flange assembly essentially coinciding with the passage of the well head.

The invention also comprises a method for retrieving an apparatus for monitoring physical parameters in an annulus of an oil and/or gas well having a well head.

13 Claims, 8 Drawing Sheets

(51) Int. Cl.
*E21B 33/035* (2006.01)
*E21B 47/00* (2012.01)

(56) References Cited

U.S. PATENT DOCUMENTS

| | | | | |
|---|---|---|---|---|
| 4,116,044 | A * | 9/1978 | Garrett | 73/40.5 R |
| 5,172,112 | A | 12/1992 | Jennings | |
| 5,927,405 | A * | 7/1999 | Monjure et al. | 166/384 |
| 6,484,585 | B1 | 11/2002 | Sittler | |
| 7,000,478 | B1 * | 2/2006 | Zwollo et al. | 73/708 |
| 2004/0089074 | A1 | 5/2004 | Avisse | |
| 2006/0028916 | A1 | 2/2006 | McMechan et al. | |
| 2009/0107246 | A1 | 4/2009 | Galinsky | |
| 2011/0278007 | A1 * | 11/2011 | Howell et al. | 166/297 |

FOREIGN PATENT DOCUMENTS

| | | | |
|---|---|---|---|
| GB | 2377240 | A | 1/2003 |
| NO | 20081110 | | 9/2009 |
| WO | WO91/15740 | A | 10/1991 |
| WO | 03/016673 | | 2/2003 |

* cited by examiner

METHODS FOR INSTALLING AND RETRIEVING A WELL MONITORING APPARATUS

FIELD OF THE INVENTION

The present invention relates to an method for installing and retrieving an apparatus for monitoring physical parameters in an annulus of an oil and/or gas well having a well head. The apparatus comprises a sensor plug including a sensor and a flange assembly arranged with a bore holding a signal processing unit for communication with the sensor.

BACKGROUND OF THE INVENTION

During well completion of a fully drilled oil and/or gas well, a number of casings of different lengths and diameters will be cemented to the ground formation. Between the casings, which are disposed coaxially to each other, a so-called annulus will be formed. To prevent a leakage in the oil and/or gas well, a plurality of packer elements will suitably be arranged between the casings. The casings will be suitably suspended from a wellhead structure, where the wellhead is arranged at the top of the oil and/or gas well. The present invention will be suitable for a surface well head on board a vessel or platform located at or near the water surface, but may also be applicable for sub sea use.

A wellhead of this kind is subjected to large loads and stresses from the surrounding environment. Although the well heads are designed to be maintenance-free for a number of years, it is both desirable and necessary to carry out an inspection not only during production, but also during drilling, installation and maintenance and repair work. This inspection may take place in the form of automated operations and is carried out by monitoring a number of different parameters in the well, which parameters may for example be contamination, leaks, well pressure, the production itself, sand/erosion in the well, wellhead temperature, the state or condition of various equipment (for example, the position of a valve), corrosion etc.

It is important from a safety, reliability and cost aspect to prevent a so-called pressure leak from the well through the different annuli in the casings, and to the surroundings. If an undesirable pressure leak of this kind nevertheless occurs, various safety systems are provided to close the well even under pressure, so that well fluid which has flowed into the different annuli of the well can circulate out in a controlled manner.

By carrying out constant measurements of, for example monitoring the pressure at a number of different points in the well, an indication that a pressure increase is about to occur in the well, that a pressure leak in the well will or has already occurred, may be present at an early stage and actions can be taken to ensure that the consequences of such a pressure build-up will be minimal or prevented altogether.

Various solutions have therefore been developed to monitor and/or control pressure in an oil or gas well, Reference can be made, for example, to U.S. Pat. No. 5,172,112, in which there is known that a pressure-measuring device measures pressure in a subsea pipe. The device includes a stationary unit mounted to the exterior of the subsea pipe and a movable unit that is lowered into position next to the stationary unit whenever the pressure is to be monitored or measured. The stationary unit, which is a strain gauge, will monitor the pressure in the pipe by measuring the "strain" in the pipe. The measurements will subsequently be transmitted from the stationary unit in the form of suitable signals, whereby the movable unit will then convert these signals to give a picture of the pressure that is within the subsea pipe.

A solution is known from GB 2 286 682 where an inductive pressure transducer is used to measure the pressure within a pipe. This is accomplished by passing an alternating current within an inductor coil to generate a magnetic field. The magnetic field passes through a gap formed between the pipe and the inductor coil, and then into the pipe. The fluid flowing in the pipe will, owing to its pressure, induce stress in the pipe, which stress will cause variations in the electromagnetic properties of the material from which the pipe is made, which variations can be sensed by the magnetic field that is formed. The sensed variations can then be converted to give a pressure measurement.

A feature common to the solutions described above is that the pressure-measuring device is not arranged through the material of the measuring element. This means that the pressure-measuring device can be replaced without any danger of a leakage or the like occurring during the replacement thereof, but on the other hand these known solutions will not give a satisfactory measurement as the measuring element may be affected by the ambient temperature, loads to which the measuring element is subjected etc.

Another system for detecting a leakage in an oil and/or gas well is described in U.S. Pat. No. 4,116,044, where the system comprises a plurality of pressure-sensitive transducers that are arranged in a through hole in a wellhead. The pressure-sensitive transducers will be so arranged that they can detect a leakage in a plurality of annuli in the well. The transducers are connected through wires to a junction box which will be capable of carrying signals to a processing location. During replacement of the transducers, the well will have to be shut down as the replacement operation will involve the well being "opened".

WO 03/016673 addresses the inconvenience of shutting the well down to install or to replace the sensor. A tool for installing and removing a replaceable sensor in a subsea installation is described in WO 03/016673. The shown equipment comprises a sensor and the belonging equipment which is arranged at a rather vulnerable position at the outside of the well head

BRIEF SUMMARY OF THE INVENTION

It is an object of the present invention to provide a method for installing and retrieving an apparatus for monitoring parameters in an annulus of a working well, remedying or reducing at least one of the disadvantages of the prior art.

The apparatus installment in accordance with the invention will provide a protected location for the sensor and will be arranged with double barrier pressure tight system, thus maintaining the requirements for securing a working well at an offshore facility.

The aforementioned objects according to the present invention are achieved by method for installing and retrieving an apparatus as defined in the independent claims, with additional embodiments of the present invention disclosed in the dependent claims and the description below.

The method for installing the apparatus includes the step of installing the sensor plug in a passage in the well head, which passage communicates with an annulus of the well. The sensor plug is thus installed in a location providing protection for the sensor plug as it is positioned inside the passage and thus protected by the surrounding material of the well head. The flange assembly wherein the signal processing unit is located is provided as a relatively compact structure connected to the well head. By arranging the flange assembly as a compact structure it is less likely to be damaged, especially in comparison to the solutions of prior art.

The method for installation and retrieval of the apparatus in accordance with the invention may be used for installing the sensor plug in an empty passage of the well head or replacing a sensor plug installed in the passage with another sensor plug. Thus the sensor plug is considered a kind of replaceable sensor plug. The method for installation and retrieval of the apparatus may also include the removal of a valve removal plug and blind flange before installing the sensor plug.

The sensor plug may be installed in the passage of the well head by the use of a valve removal tool structure. The valve removal tool structure may have a valve removal tool holding the sensor plug, and the valve removal tool may be provided with a socket for holding the sensor plug. The sensor plug is installed in the passage of the well head by displacing a movable unit of the valve removal tool structure thereby inserting the sensor plug into the passage of the well head.

The number of apparatuses connected to the well head may vary from one apparatus to plural apparatuses in accordance with the need of use. The various passages of the well head may be provided with one apparatus each, or some passages may accommodate an apparatus and other not.

In the case where the well head is provided with plural apparatuses, at least one of these may be arranged to communicate with at least one of the other apparatuses.

The sensor of the sensor plug is provided to monitor physical parameters in an annulus such as pressure and temperature, but it should be understood that the sensor may also be designed so as to be capable of measuring other parameters or additional parameters. The apparatus in accordance with the invention is arranged to be installed in a passage of a well head, wherein the well head also may include a christmas tree for the monitoring the physical parameters in an annulus of an oil and/or gas well. As an alternative use the sensor plug may be installed in a production line for monitor the physical parameters in the process fluids.

Signals representing the measurements sensed by the sensor are transmitted from the sensor to the signal processing unit in the bore. The signal processing unit will then either be able to process the received signals themselves, or send these signals to another receiving and/or processing unit for further processing via one or more electric wires, one or more signal cables etc., or even wirelessly.

After the sensor plug has been installed in the passage of the well head the flange assembly needs to be installed. The method for installation in accordance with the invention further comprises the step of connecting a cable connector to the sensor plug. The cable connector is attached to an end of a cable, connecting the sensor of the sensor plug to the signal processing unit in the bore of the flange assembly. Further steps comprises positioning the bore of the flange assembly essentially coinciding with the passage of the well head thereby inserting the cable connector into the bore and attaching the flange assembly to the well head. The attachment of the flange assembly to the well head may be carried out by the use of attachment means suitable for making a reliable connection between the flange assembly and the well head, for instance by the use of bolts and nuts or other suitable means.

In one embodiment installing the sensor plug in the passage, further comprises the following steps;

Connecting a valve removal tool structure to a valve structure premounted to the well head. The valve structure, which may be a gate valve or another kind of valve suitable for the application, has a closed and an open position. The valve structure is in its closed position, when the valve removal tool structure is connected to the valve structure. The valve removal tool structure has a valve removal tool holding the sensor plug, and may be provided with a socket for holding the sensor plug. The method according to this embodiment further comprises bringing the valve structure into its open position and inserting the sensor plug through the valve structure and into the passage of the well head using the valve removal tool.

When installing the sensor plug in the passage the following steps may take place before bringing the valve structure into its open position and inserting the sensor plug through the valve structure and into the passage of the well head using the valve removal tool: Pressure testing the valve structure in its closed position, and bleeding down the pressure of the valve structure to a pressure essentially close to annulus pressure. These steps are thus carried out after the valve removal tool structure is connected to the valve structure, when the valve structure is in its closed position. Further, the inserting of the sensor plug through the valve structure and into the passage of the well head using the valve removal tool may comprise providing the valve removal tool with a movable unit, and displacing the movable unit thereby inserting the sensor plug through the valve structure and into the passage of the well head. The movable unit may comprise telescoping elements or other elements capable of carrying out the displacement of the sensor plug through the valve structure and into the passage. The valve removal tool may be used for screwing the sensor plug into the passage of the well head engaging threads arranged on the outer wall of the sensor plug into engaging threads provided in the inner wall of the passage, or fastened to the well head by other suitable means. Further the method in this aspect comprising detaching the sensor plug from the valve removal tool after being installed in the passage.

By this installing of the sensor plug to the well head a pressure tight closure of the passage in communication with an annulus is obtained. Also the sensor of the sensor plug is protected by being located in the passage surrounded by the material of the well head.

When the sensor plug is installed in the passage of the well head the following steps may take place; Pressure testing the sensor plug thus making sure the sensor plug is tightly connected with the well head. Thereafter bleeding off pressure in the valve structure, and removing the valve removal tool structure. Closing the valve structure and removing the valve structure. In some cases the valve structure will be left connected to the well head, and thus this latter step of removing the valve structure will not take place.

In some situations a valve removal plug and a blind flange may be installed in the passage of the wellhead, and then these need to be removed before installing the sensor plug in the passage. The method for removing the valve removal plug and the blind flange include the following steps: Verifying pressure integrity of the valve removal plug. Removing the blind flange closing off the passage of the well head. Connecting a valve structure having an open and a closed position to the well head in communication with the passage of the well head. If the valve structure is already connected to the well head, this step is skipped. The valve structure needs to pressure tested in its closed condition. A valve removal tool structure, preferably of the same kind as used for installing the sensor plug is used for removing the valve removal plug. The method in this aspect comprises the step of connecting a valve removal tool structure to the valve structure. The valve removal tool structure has a socket for a valve removal plug. Steps are carried out for bleeding down the pressure of the valve structure to a pressure essentially close to annulus pressure. The valve structure is the opened and ready for removing the valve removal plug through the valve structure using the valve removal tool structure. Thereafter removing the valve removal plug from the valve removal tool structure. The valve removal tool structure may now be ready for installing the sensor plug into the passage of the well head.

The valve removal tool structure may be provided as one unit or may comprise the valve removal tool and a connecting structure for the valve removal tool. In the latter case the connecting structure serves as support structure for the valve removal tool to be connected to the valve structure. The step comprising connecting a valve removal tool structure to the valve structure, may then comprise the following steps; attaching the connecting structure for the valve removal tool to the valve structure, and attaching the valve removal tool to the connecting structure. Alternatively, the valve removal tool may be connected to the support structure, and the support structure with the valve removal tool attached may be connected to the valve structure. The support structure may be provided as a cylinder flange or other structures that fit for connection with the valve structure of choice.

In the bore of the flange assembly holding the signal processing unit, the cable with the cable connector attached at one end has, the other end connected to an isolation element arranged in the bore of the flange assembly. The cable may comprise several wires with ends connected to the isolation element. The isolation element provides electrical isolation within the bore, but is also be arranged for transmittance of electrical signals from the sensor of the sensor plug to the signal processing unit located in the bore and separated from the sensor plug by the isolation element. The isolation element may have designated areas having electrically conducting features, or the electrical signal may for instance be transmitted through the isolation element by the use of wires or conductors included in the isolation element. The isolation element has a diameter corresponding to the diameter of the bore wherein it is located. A sleeve is arranged in the bore to provide pressure on to the isolation element for the isolation element to exert pressure onto a seal. The sleeve is arranged at a first side of the isolation element facing the sensor plug, and the seal is located at a second side of the isolation element facing away from the sensor plug The seal is in contact with a restriction portion in the bore, and by pressurizing the seal it engages in a sealing contact with this restriction portion. The sleeve is to be arranged in a pressurizing position relative to isolation element, and the isolation element is to be arranged in a position wherein the seal is brought into a sealing contact with the restriction portion, thereby causing an isolation of the portion of the bore wherein the signal processing unit is arranged from the portion of the bore facing the sensor plug. The sleeve may be arranged with means for holding the sleeve relative to the bore in the pressurizing position, and in one aspect the sleeve may be provided with threads which engage with threads in the bore such as to easily be put in the pressurizing position. Further, the isolation element may be provided at least in parts by a fairly rigid material. When the sleeve is moved into the pressurizing position the isolation element being fairly rigid and of a non compressible nature, for instance a ceramic, may then be moved into a position wherein the seal is compressed and sealing contact is obtained with the restriction portion provided in the bore. By these aforementioned arrangements an additional pressure tight closure is obtained for the apparatus thus providing a double barrier system for the passage leading into an annulus of the well head. As well as being a pressure tight closure arrangement it is also a fire safe barrier between the signal processing unit and the passage holding the sensor plug.

The flange assembly installed to the well head needs to be tested and the method for installation thus in one embodiment includes steps for carrying out a pressure test of the flange assembly; The first step comprises introducing a fluid into at least one flow passage mouthing into a portion of the bore of the flange assembly, and thereafter pressurizing the fluid filling the flange assembly.

In a further embodiment for installing the apparatus the method further comprises connecting a control cable to the signal processing unit of the flange assembly through an opening in the wall of the flange assembly.

As an alternative or in the case where the apparatus is provided with more than one opening the method further comprises mounting an antenna in an opening in the wall of the flange assembly, which antenna communicates wirelessly with the signal processing unit in the flange assembly.

In an embodiment of the apparatus for monitoring parameters there is provided one or more batteries or battery packs, which provide necessary power as required. However, this can also be accomplished by connecting the apparatus to one or more power supplying wires.

As stated in the introduction of the description, the invention also includes a method for retrieving an apparatus for monitoring physical parameters in the annulus of an oil and/or gas well having a well head. The apparatus may be installed in accordance with the installation method as mentioned above. The constructional features of the apparatus as described above also applies for the apparatus in accordance with this method and is therefore not repeated here. The method for retrieving the apparatus comprises the following steps; Disconnecting a control cable or (depending on the sensor system in use) optionally remove battery in connection with the signal processing unit of the flange assembly. Removing the flange assembly from engagement with the well head, in the case where bolts/nuts are used as attachment means, releasing the nuts from the bolts. The method further includes the step of disconnecting a cable connector attached to the sensor plug, which cable connector is attached to an end of a cable connecting the sensor of the sensor plug to the signal processing unit in the bore of the flange assembly. And further the method comprises the step of connecting a valve structure to the well head in communication with the passage in the well head, which valve structure has an open and a closed position, and then removing the sensor plug through the valve structure in an open position using a valve removal tool structure.

As mentioned earlier the valve structure may be a gate valve or any other valve suitable for connection with the well head.

In accordance with one embodiment of the method the step of removing the sensor plug through the valve structure in an open position using a valve removal tool structure, further comprises the following steps; connecting the valve removal tool structure to the valve structure in its closed position, which valve removal tool structure has a valve removal tool provided with a socket for the sensor plug. Opening the valve structure and displacing a movable unit of the valve removal tool structure through the valve structure to engage the socket with the sensor plug in the passage of the well head. Removing the sensor plug by retracting the movable unit of the valve removal tool through the valve structure in its open position. As mentioned above the movable unit may comprise telescoping elements. The sensor plug may be released from the passage by screwing, in the case where the sensor plug is arranged with threads matching threads in the passage, thereby unwinding the sensor plug from the passage of the well head.

After removing the sensor plug from the passage, the method for retrieving the apparatus may comprise the following steps; closing the valve structure, and bleeding off pressure of the valve structure, and thereafter removing the valve removal tool structure from the valve structure.

As mentioned above the valve removal tool structure may be provided as one unit or may comprise the valve removal tool and a connecting structure for the valve removal tool. In the latter case the connecting structure serves as support structure for the valve removal tool to be connected to the valve structure. The step of connecting the valve removal tool structure to the valve structure in its closed position, which valve removal tool structure has a valve removal tool provided with a socket for the sensor plug, may then comprise the following steps; attaching the connecting structure for the valve removal tool to the valve structure, and attaching the valve removal tool to the connecting structure. Alternatively, the valve removal tool may be connected to the support structure, and the support structure with the valve removal tool attached may be connected to the valve structure. The support structure may be provided as a cylinder flange or other structures that fit for connection with the valve structure of choice. This may be carried out before removing the sensor plug from the passage Further, in the case when the valve removal tool structure comprises a connecting structure for the valve removal tool, which connecting structure is attached to the valve structure and the valve removal tool is connected to the connecting structure, the following steps take place; detaching the valve removal tool from the connecting structure and detaching the connecting structure from the valve structure.

BRIEF DESCRIPTION OF THE DRAWINGS

In the following an example of an embodiment of the invention will be described by way of reference to the figures.

DETAILED DESCRIPTION OF THE INVENTION

Figure 1:
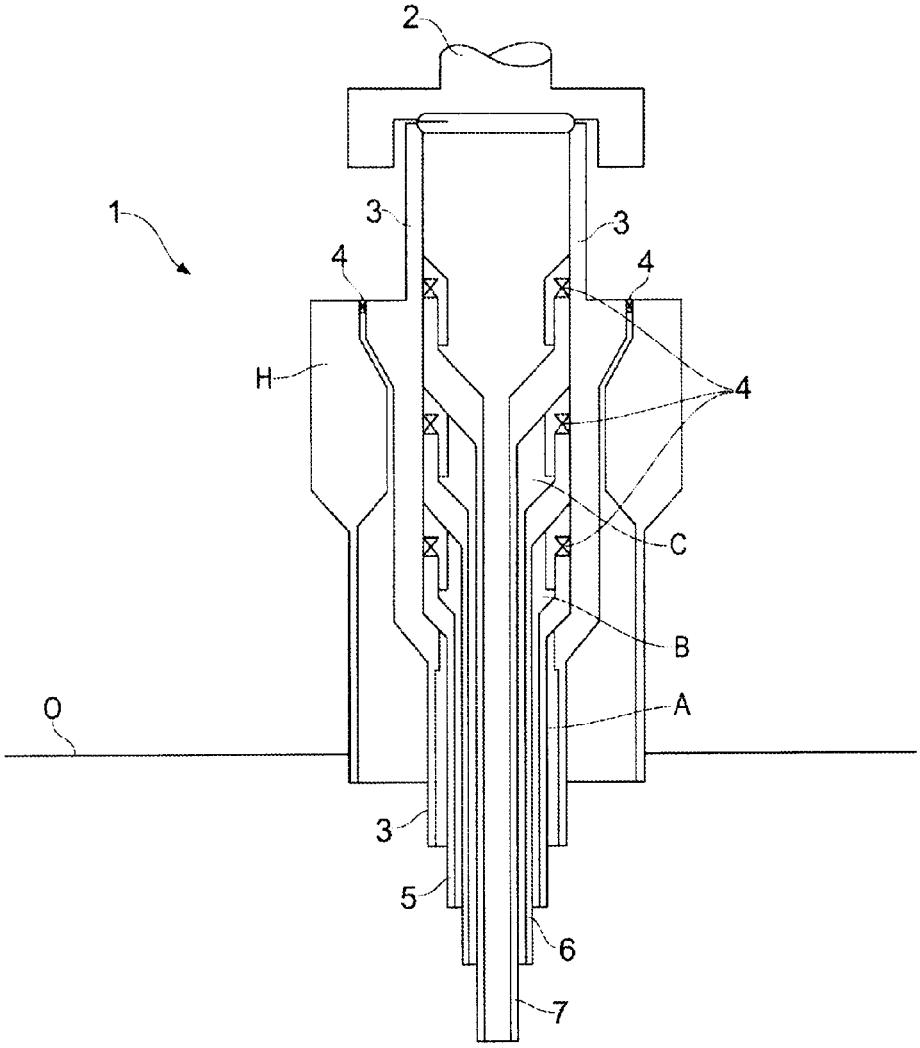
FIG. 1 shows an arrangement of a typical well head structure.

FIG. 1 shows a typical wellhead structure that is used in connection with an oil and/or gas well, where a wellhead 1 may be a surface well head located on board the floating structure, such as a platform or the like. A Christmas tree may be attached to the well head for production purposes. A riser 2 extends between the floating structure and the wellhead 1.

As shown in FIG. 1 a number of casings 3, 5, 6 and 7 are arranged within each other in a manner where the casing arranged inside the preceding casing successively extends further into the surface formation O, so that the innermost casing extends the furthest distance down into the surface formation O. Each casing has a decreasing diameter compared to the preceding casing. The upper end of the first casing 3 is suitably suspended from the wellhead 1. Sealing devices 4 in the form of one or more packers are arranged in between in the casings, and for the outer casing 3 a sealing device 4 is arranged between an exterior surface of the outer casing 3 and an interior surface of a housing H of the wellhead 1. The space that is provided in between the casings 3, 5, 6 and 7 defines annuluses A, B, C that are sealed by the sealing devices.

The well head 1 is provided with plural passages (not shown in FIG. 1) each in fluid communication with one of the annuli A, B, C. To monitor the condition, for example pressure and/or temperature, in each of the annuli A, B, C an apparatus 8 comprising a sensor plug 10 as shown in FIG. 2 is inserted into a passage 9 of the well head in fluid communication with the respective annuli A, B, C. As the skilled person will understand, a set of apparatuses 8 as the one shown in FIG. 2 may be applied one to each passage of the well head to monitor the various annuli of the well.

Figure 2A:
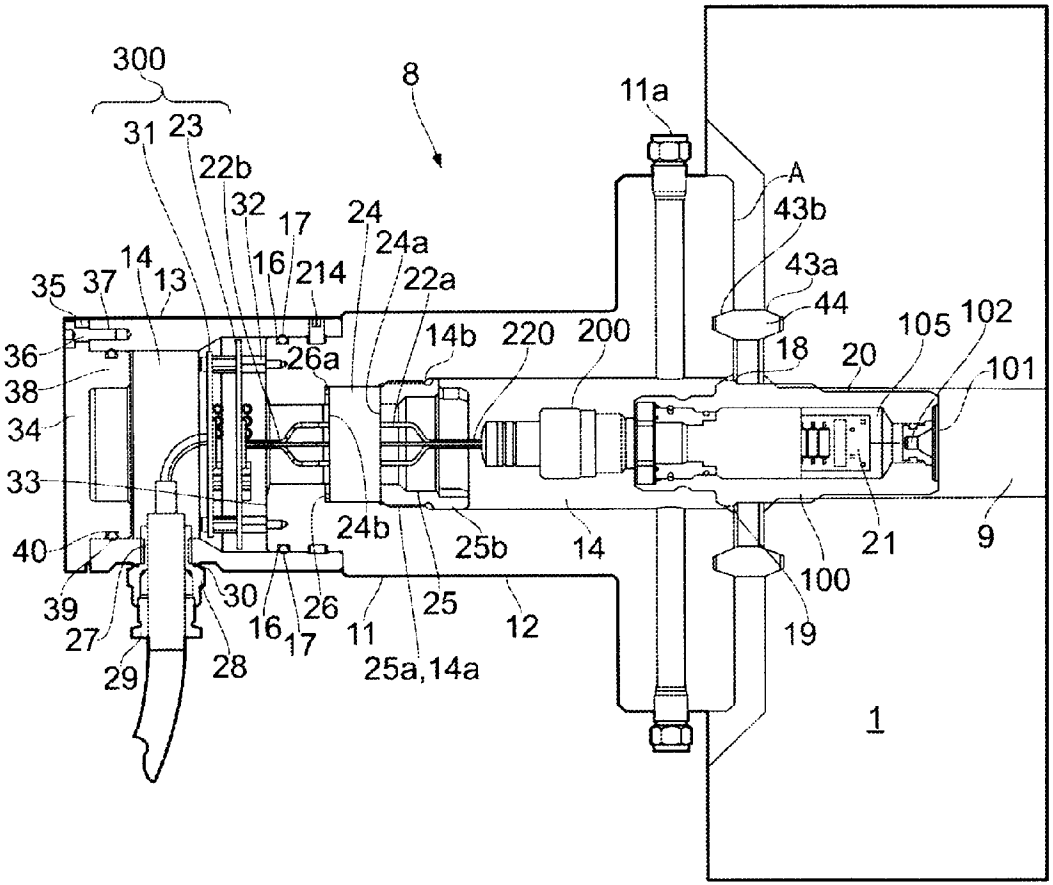
FIGS. 2*a*, 2*b* show an embodiment of a wired version of the apparatus as installed to the well head.
Figure 2B:
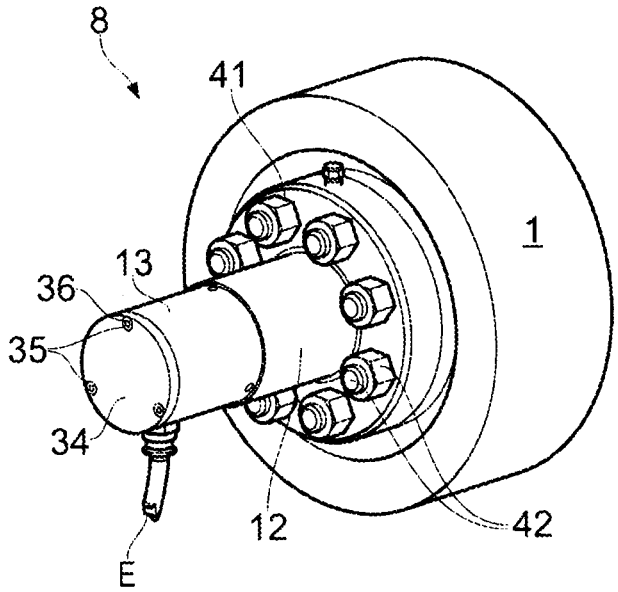

FIG. 2*a*, 2*b* show a first embodiment of the apparatus 8 for the monitoring of the annuli, as shown in FIG. 1. The apparatus comprises a sensor plug 10 which is shown inserted into the passage 9 of the well head 1. The sensor plug 10 is shown comprising a sensor 100 which includes a temperature transducer 101, a pressure transducer 102 and a sensor board 21. The equipment for monitoring the signals from the sensor may be arranged as a so called strain gauge solution which may be used in a location close to the sensor.

The sensor plug 10 may, at least along a part of its length, be configured with a threaded portion 20, to be able to screw the sensor plug 10 in the passage 9 engaging with a complementarily threaded portion in the wall of the passage 9. By this arrangement of anchoring the sensor plug in the passage, a pressure tight closure of the passage 9 leading into the respective annulus is provided.

The apparatus 8 further comprises a flange assembly 11. A cable connector 200 is connected to the contact end of the sensor plug 10 projecting out from the passage 9. This cable connector 200 and the projecting end of the sensor plug 10 are accommodated in a bore 14 of the flange assembly 11. Further, the flange assembly is connected to the well head 1 by attachment means, for instance bolts 42 fastened to the well head 1. The stud bolts 42 fit into openings provided in the flange assembly 11 and nuts 41 are arranged to attach the flange assembly 11 to the well head, see FIG. 2*b*. Further a sealing assembly is provided for sealing off the connection between the well head 1 and the flange assembly, when the flange assembly 11 is connected to the well head 1 by the use of attachment means as described above. For instance a sealing ring 44 is provided to be accommodated in a recess 43*a* in the well head 1 and into a corresponding recess 43*b* in face A of the flange assembly facing the well head 1.

The cable connector 200 is attached to a cable 220 which may comprise several wires 22*a* as shown in FIG. 2*a*. The wires 22*a* are shown with their ends connected to first side 24*a* of an isolation element 24. Some parts of the isolation element 24 have features providing electrical isolation whereas other parts of the isolation element 24 are provided for transmittance of electrical signals. The isolation element 24 may have designated areas having electrically conducting features, or the electrical signal may for instance be transmitted through the isolation element 24 by the use of wires or conductors included in the isolation element 24. In one embodiment, the isolation element 24 is configured with at least one through-going portion or area comprising a mixture of a ceramic material and an electrically conducting material (for example, platinum).

The isolation element 24 is located in a portion of the bore 14 where the diameter is reduced. The isolation element 24 is shown fitted into a portion of the bore having a diameter corresponding to the diameter of the isolation element 24. A sleeve 25 is located in the bore 14 in engagement with a first side 24*a* of the isolation element facing the passage 9. The sleeve 25 in this position exerts pressure to the isolation element 24. In the embodiment shown in FIG. 2, the sleeve is configured with threads 25*a*, 14*a* provided for engagement with threads in the bore 14, and is provided with a diameter enlarged portion 25*b* arranged to fit with a restriction 14*b* of the bore 14 which may provide an end stop for the sleeve 25. By engaging the threads 25*a* of the sleeve 25 with the threads 14*a* of the bore 14, the sleeve may be screwed into a position exerting a pressure to the isolation element 24. A second side of the isolation element 24, which faces away from the passage 9, rests against a restriction in the diameter of the bore providing a contact portion 26. In between the contact portion 26 and a portion of the second side of the isolation element a seal 26*a*, for instance a metallic seal, is provided. By moving the sleeve 25 relative to the bore 14, for instance by screwing the sleeve 25 relative to the bore 14 the isolation element 24 exerts a force to the seal 26*a* of a size which provides an isolation engagement between the contact portion 26, the seal and the isolation element 24. This arrangement provides for a pressure tight arrangement. Consequently, the portion of the bore facing the first side 24*a* of the isolation element 24 is separated from the portion of the bore facing the second side 24*b* of the isolation element 24. By the pressure tight arrangement an isolation of the passage 9 is achieved, in addition to the pressure tight closure of the sensor plug in the passage 9, thus ensuring a double barrier closure of the passage 9. The pressure tight arrangement also provides fireproof. As the skilled person will realize the pressure of the sleeve exerted on the isolation element 24 may be provided by other means than screwing as described in accordance with this embodiment, for instance the sleeve may be imbedded in the bore 14 of the flange assembly. The isolation element 24 may be held in position using an alternative pressure connection.

In the embodiment shown in FIG. 2 wires 22*b* having one end connected to the second side 24*b* of the isolation element 24. The other end of the wires 22*a* are connected to a signal processing unit 300, in FIG. 2 shown as a main printed circuit board 33 and a connecting printed circuit board 31, the latter is arranged in a distance from the main printed circuit board 33. The main printed circuit board as shown in FIG. 2 serves as an interface board, whereas the connecting printed circuit board 31 provides signals for further communication out of the flange assembly 11.

As shown in the embodiment in FIG. 2 a rear flange portion 13 of the flange assembly is configured with an opening 27, here shown as a through and threaded hole, so as to enable a cable lead-in 28, in this example also comprising a tensioning nut 29, to be connected to the opening 27. Between the contact faces of the rear flange portion 13 and the cable lead-in 28 there is arranged a seal 30 in the form of an O-ring. A cable E is then passed through the cable lead-in 28 and connected to a connecting printed circuit board 31 in the though bore 14 in the flange assembly 11.

The separate main printed circuit board 23 and connecting printed circuit board 31 are, by means of a securing device 32, connected to a rear wall 33 of a front flange portion 12 of the flange assembly 11. The securing device 32 will further ensure that the main printed circuit board 23 and the connecting printed circuit board 31 are arranged at a distance from each other. Signals received from the sensor 105 will then be wirelessly transmittable from the main printed circuit board 23 to the connecting printed circuit board 31, in order thus, through the electric wire E, to be transmitted for processing on a floating structure (not shown)

The rear flange portion 13 is connected to the front flange portion 12 1 by bolts 14. Further, the flange portion 13 is configured for receiving an end termination 34. Bolts 36 are used for the fastening of the end termination to the rear flange portion 13. The end termination 34 is shown in FIG. 2 with a projection 38 having a diameter corresponding to the diameter of bore 14. A seal 39 in the form of an O-ring is arranged between the interior surface of the rear flange portion 13 and the exterior surface of the projection 38, one or both of these surfaces then being configured with a groove for receiving the seal 39.

Furthermore, the flange assembly in a face A forms contact with the wellhead 1, and is configured with a plurality of holes 41, such that bolts and nuts 42 can be used to fixedly connect the apparatus 8 to the wellhead 1.

Figure 3:
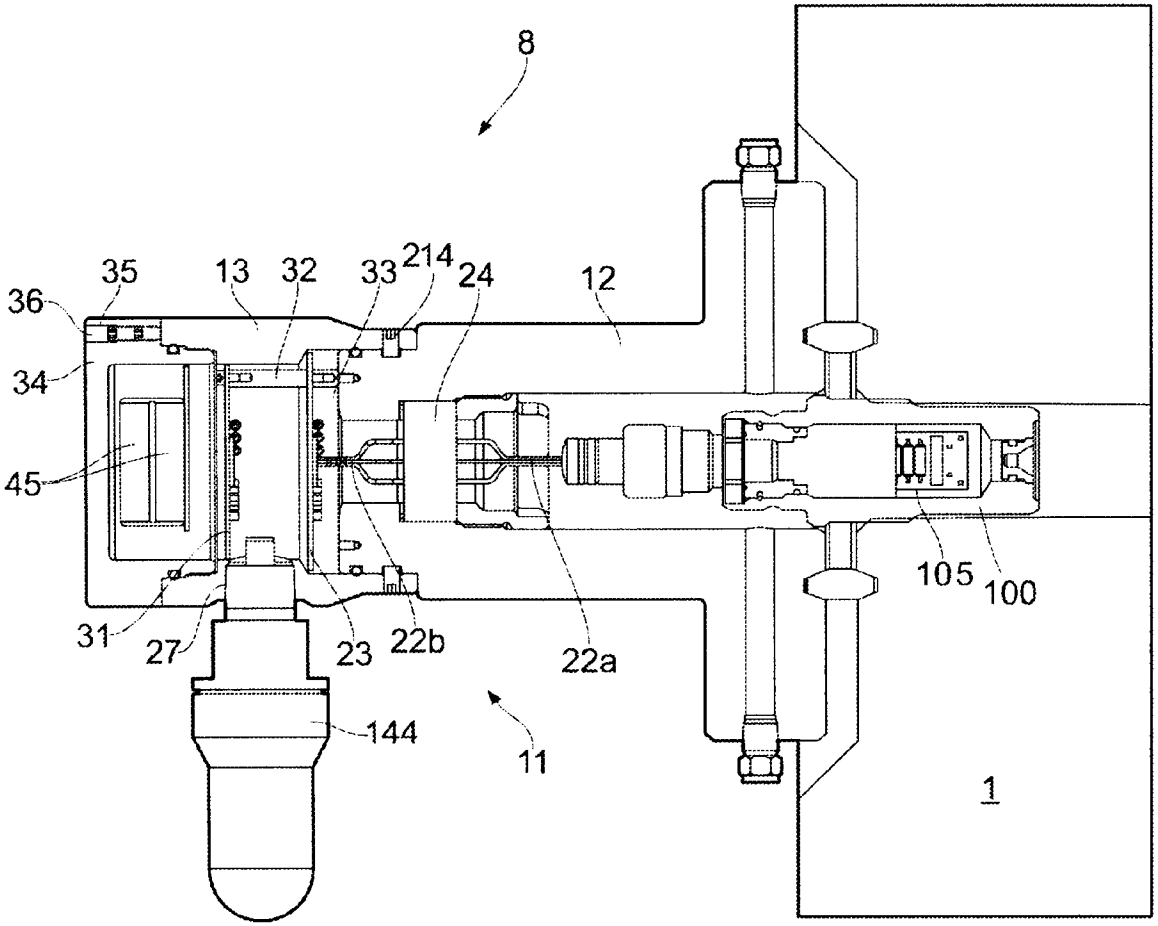
FIG. 3 shows an embodiment of a wireless version of the apparatus as installed to the well head.

FIG. 3 shows another embodiment of the apparatus 8 according to the present invention, where the apparatus 8 is configured to transmit signals wirelessly from apparatus 8 to a floating structure (not shown). The general component composition of the apparatus 8 and its operating principle are the same as described for the first embodiment of the invention as shown in FIG. 2, and so for the sake of simplicity they are not described again.

The embodiment shown in FIG. 3 uses a wireless transmission of signals from the apparatus, where the flange assembly here shown by the rear flange portion 13 will be configured with an opening 27, here shown as a through and threaded hole, so as to enable a wireless antenna 144 to be connected to the opening 27. A securing device 32 is also used in this embodiment to connect the separate main printed circuit board 23 and the connecting printed circuit board 31 to the rear wall 33 of the front flange portion 12. However, the distance between the main printed circuit board 23 and the connecting printed circuit board 31 will now be greater than in the embodiment described with reference to FIG. 2, as a part of the wireless antenna 144 will extend a distance into the bore 14 in the flange assembly 11. Signals received from the sensor 100 will then be wirelessly transmittable from the main printed circuit board 23 to the connecting printed circuit board 31, so as to be further transmittable wirelessly from the connecting printed circuit board 31 to the wireless antenna 144, in order to be further transmitted wirelessly for processing on a floating structure (not shown). For signal amplification, a plurality of signal amplifying units (not shown) may be provided between the wellhead and the floating structure.

To operate the sensor 105 and/or the wireless antenna 144 in the apparatus 8, a battery or a battery pack 45 is provided in the apparatus 8 when the apparatus 8 is assembled. In accordance with this the battery or battery pack 45 can easily be replaced by unscrewing bolts 36 in the end termination 34 and removing the end termination 34 from the rear flange portion 13. The battery or battery pack 45 may in a suitable manner, for example, by means of wires etc. (not shown), be connected to the connecting printed circuit board 31.

Figure 4A:
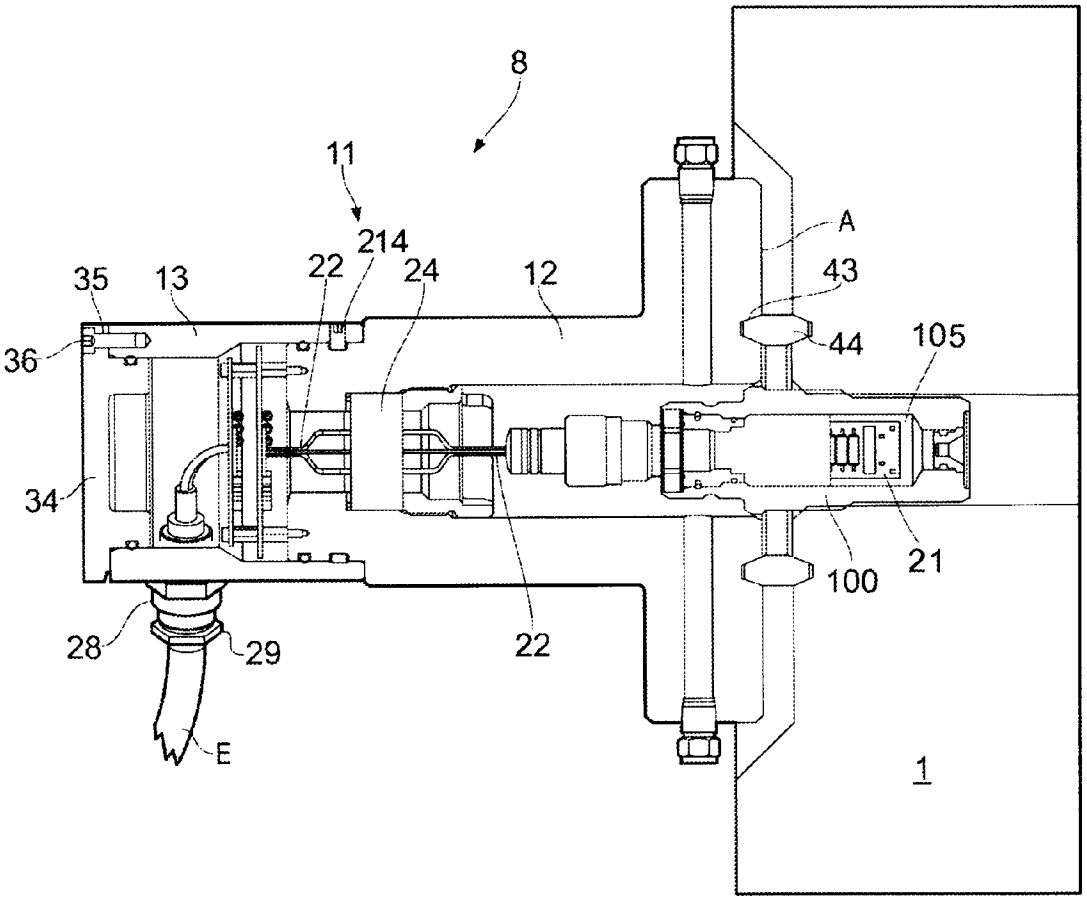
FIGS. 4*a*, 4*b*, 4*c* shows an embodiment having to openings for the attachment of an antenna and a cable to the apparatus.
Figure 4C:
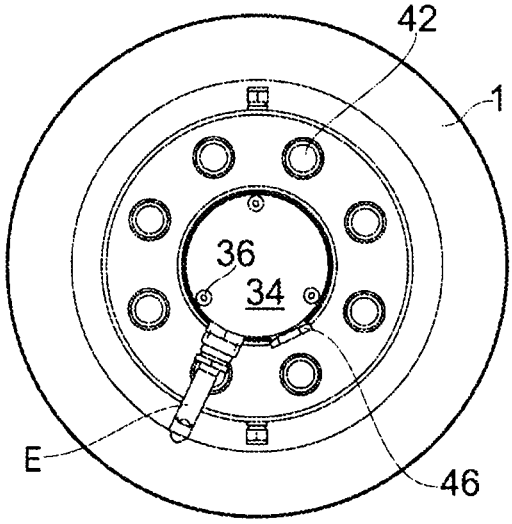
Figure 4B:
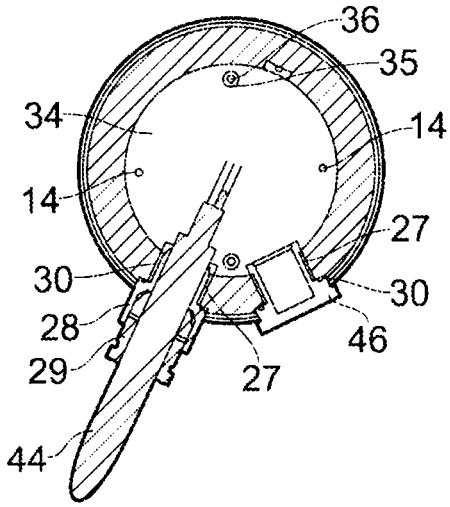

FIGS. 4*a*, 4*b* and 4*c* show an additional embodiment of the apparatus 8 according to the present invention, where the rear flange portion 13 in the apparatus 8 is configured with several openings 27 here shown as through and threaded holes. The general component composition of the apparatus 8 and its operating principle are the same as described for the first embodiment of the invention as shown in FIG. 2, and so for the sake of simplicity they are not described again.

Configuring the apparatus 8 with several openings 27 such as through and threaded holes, will enable the apparatus 8 to be connected to two electric cables E, an electric cable E and a wireless antenna 144, or even two wireless antennas 144. Alternatively, one of the openings 27 can initially be closed by a stop plug 46. If, for example, the electric wire E or the wireless antenna 144 for some reason is knocked off or damaged there will be the possibility of connecting to the apparatus 8 by removing the stop plug 46 and, for example, coupling a wireless antenna 144 to the other opening 27.

In addition, this embodiment will also permit several similar apparatus to be connected on the same line, where the apparatus will then be able to communicate with each other digitally.

FIGS. 5*a*-5*f* show the steps for installation/retrieving of the apparatus 8 as shown on the FIGS. 1-4.

Figure 5A:
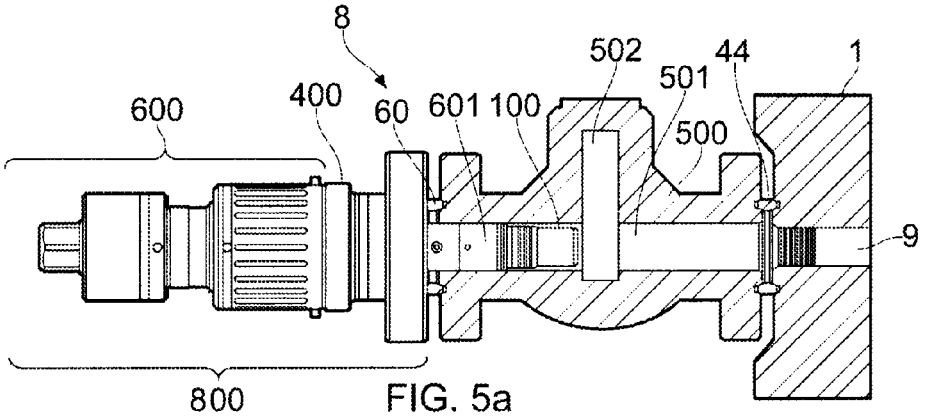
FIG. 5*a*-5*f* shows an embodiment of an installation procedure for the wired version of the apparatus as shown in FIG. 1.

As shown in FIG. 5*a* a valve structure 500 such as for instance a gate valve is mounted to the well head. The valve structure 500 has a through bore 501 which is shown essentially in alignment with the passage 9, as the valve structure 500 is attached to the well head 1. A movable valve element 502 is in its closed position preventing communication through the through bore 501. Attachment means and the sealing arrangement, here shown as a sealing ring 44 ensure that the valve structure 300 is attached to the well head 1 in a sealed manner for the communication of the pressure of the passage 9 into the through bore 501 without leakage to the environment. A support structure 400 for a valve removal tool 600 is connected to the valve structure 500 by connecting means and sealing means 60 in a sealed manner ensuring no leakage in the connection between the valve structure 500 and the support structure 400. An sensor plug socket 601 is mounted on the valve removal tool 600 and the sensor plug 100 is attached to the installation socket 601. The valve removal tool 600 is thereafter connected to the support structure 400 in a sealed manner to ensure a leakage free connection between the valve removal tool 600 and the support structure 400. As an alternative to first installing the support structure 400 and thereafter the valve removal tool 600, the valve removal tool 600 and the support structure 400 comprises a valve removal tool structure 800 which is installed as a unit to the valve structure 500.

In this position of the valve removal tool 600, the sensor plug 100 is located in a portion of the through bore 501 with the sensor plug 100 in the installation socket 601, as shown in FIG. 5*a*. A pressure test is then performed with the valve element 502 in its closed position to check for possible leakage. The pressure is then bled down to a pressure essentially equalizing the pressure of the annulus in communication with the passage 9, and the movable valve element 502 is brought to an open position.

Figure 5B:
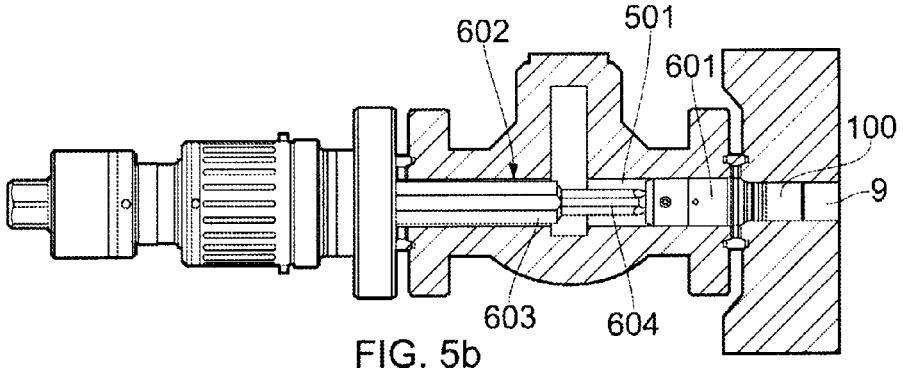

As shown in FIG. 5*b* a movable unit 602 of the valve removal tool 600 is displaced into the through bore 501, here illustrated by an example of the movable unit 602 comprising telescoping tool parts 603, 604, moving the sensor plug 100 through the through bore 501 of the valve structure 500. The sensor plug 100 enters the passage 9 by using the valve removal tool 600 for screwing the sensor plug 100 into the passage engaging the threads of the sensor plug 100 with the use of the corresponding threads in the passage 9.

Figure 5C:
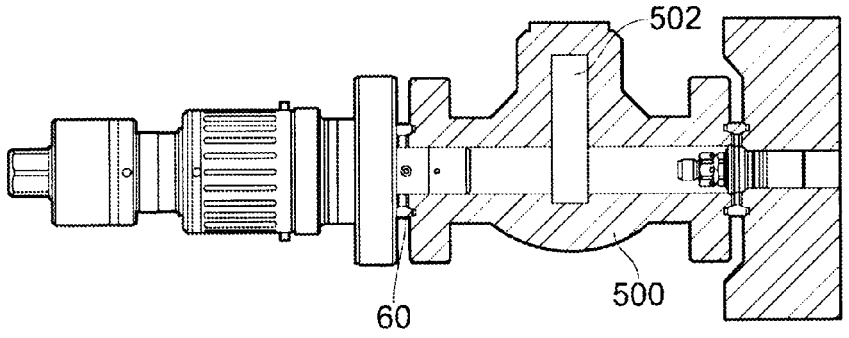

The sensor plug 100 is now installed in the passage 9 of the well head 1, and the movable unit 602 is released from the sensor plug 100. The movable unit 602 is then returned through the through bore 501 and into the valve removal tool as shown in FIG. 5*c*. A pressure test for sensor plug 100 is carried out, before the pressure of the valve structure is bled down and the movable valve element 502 is brought to its closed position, closing off the through bore 501. Thereafter the valve removal tool 600 and the support structure 400 are released from the valve structure 500, followed by removing the valve structure 500 from the well head.

The sensor plug 100 is now installed in the passage 9 as shown in FIG. 5*c*. The installation of flange assembly 8 as shown connected to the well head 1 in the FIGS. 2-4 is to be described in the following;

The flange assembly 11 is positioned close to the well head and a discharging wire (not shown) will be attached between the flange assembly and the well head. The cable connector 200 is then connected to the contact end of the sensor plug 100 which is projecting out from the well head 1. The cable connector 200 is located at the end a cable 220 which may comprise several wires 22 as described above. The flange assembly 11 is positioned so that the bore 14 of the flange assembly essentially is coinciding with the passage of the well head. The cable connector 200 and the projecting end of the sensor plug are inserted into the bore 14 of the flange assembly 11 when the flange assembly is moved to fit the openings provided in the flange assembly 11 with the attachment means such as bolts arranged to the well assembly, not shown in FIG. 5*e*.

The discharging wire is removed and the attachment means are tightened for instance by the tightening of nuts to make a reliable connection. To pressure test the flange assembly a fluid, for instance a dialectic oil, is introduced into a flow passage 11*a*. The fluid fills up the portion of the bore separated by the first side of the isolation element 24 facing the sensor plug 100, the fluid then is pressurized to check for leaks.

To communicate signals from the apparatus 8 to a receiving structure (not shown) for instance on board a floating structure (not shown) the control cable E or alternatively the wireless antenna 144 (if not preinstalled into its respective opening of the flange assembly) communicating with the signal processing unit 300 of the flange assembly 11 as shown in FIG. 3 needs to be installed.

Figure 5D:
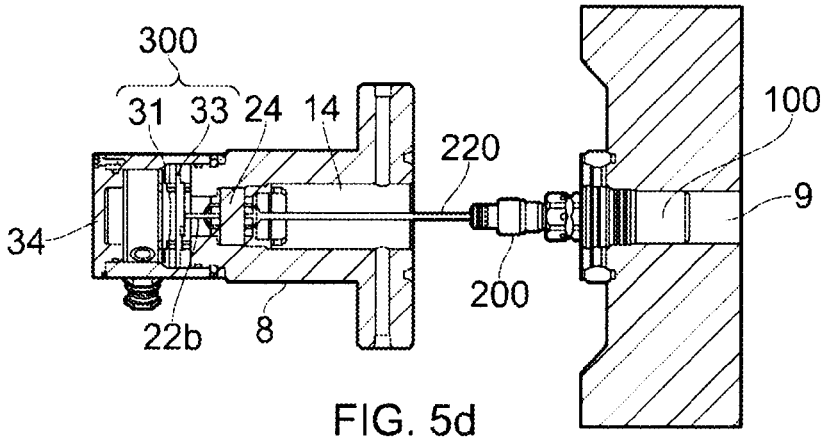
Figure 5E:
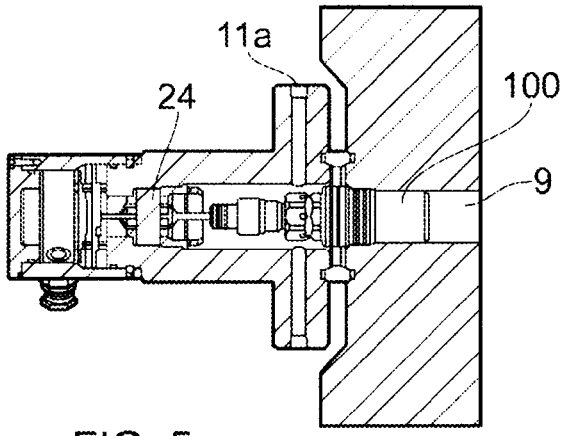
Figure 5F:
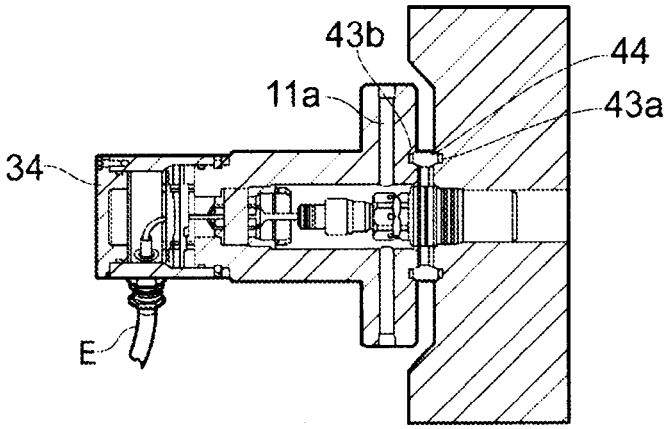

In FIG. 5*f* the apparatus is shown with control cable E installed. To attach the control cable E to the signal processing unit 300, the end termination 34 is removed from the flange assembly 11. The procedure is carried out by the following steps; feeding the control cable E through the cable lead-in 28. Installing the cable lead-in 28 in the opening 27 through the wall of the flange assembly. In the case where the opening 27 is threaded, the cable lead-in is screwed into the opening 27. If a tensioning nut 29 is present, as is the case in the embodiment of the apparatus 8 shown in the FIGS. 2*a*, 2*b* the tensioning nut 29 is tightened to keep the control cable E in place. Testing of the sensor and the configure settings is carried out and the end termination 34 is reattached to the flange assembly 11.

If the antenna 144 is to be installed instead of the control cable E as shown in FIG. 5*f*, the antenna 144 is installed in the opening 27. If the opening 27 is threaded, the antenna 144 is screwed into the opening 27. Further, the procedure is carried out by the following steps; removing the end termination 34 from the flange assembly 11. Installing the battery 45 in the bore of the flange assembly. Carrying out the testing of the sensor and configuring the settings, and install the end termination 34 to the flange assembly again.

A method for retrieving the apparatus 8 from the well head 1, is to be described in the following, starting with the installed apparatus 8 as shown in FIG. 5*f*. The pressure integrity of the sensor plug 100 is usually tested and verified before starting removing the apparatus 8 from the well head 1. The method of retrieving the apparatus 8 comprises disconnecting the control cable E optionally and/or the antenna 144 and optionally the battery 214, (depending on the use of control cable, antenna or both as for the apparatus as discussed earlier). A discharging wire (not shown) is then attached between the flange assembly and the well head 1. The method further comprises removing the flange assembly 11 from engagement with the well head 1, as seen in FIG. 5*d*. This may be carried out by loosing the attachment means such as the bolts 41 from engagement with openings in the flange assembly by loosening the nuts 41.

The cable connector 200 is released from the end of the sensor plug 100, and then the valve structure 500 is connected to the well head as shown in FIG. 5*c*. The movable valve element 502 is in its closed position and the support structure 400 for the valve removal tool 600 is connected to the valve structure 500 by connecting means, similar to the procedure as described when installing the sensor plug 100. The sensor plug socket 601 is mounted on the valve removal tool 600 and the valve removal tool 600 is thereafter connected to the support structure 400 in a sealed manner as further shown in FIG. 5*c*. A pressure test is then performed with the valve element 502 in its closed position to check for possible leakage. The pressure is then bled down to a pressure essentially equalizing the pressure of the annulus in communication with the passage 9. The movable valve element 502 is then brought to an open position.

As shown in FIG. 5*b* the movable unit 602 of the valve removal tool 600 is displaced into the through bore 501, here illustrated by the movable unit 602 comprising telescoping tool parts 603, 604 bringing the socket 601 into engagement with the sensor plug 100. The sensor plug 100 is released from passage 9, by screwing the sensor plug out from the passage. The movable unit 602 is then returned through the through bore 501 with the sensor plug 100 attached to the sensor plug socket 601. The movable valve element 502 is then brought to a closed position and the pressure of structure 500 is bled off. The valve removal tool 600 with the sensor plug 100 attached to the sensor plug socket 601 is then released from the support structure 400, and the sensor plug 100 is free to be removed from the sensor plug socket. Alternatively, the valve removal tool 600 and the support structure 400 comprises a valve removal tool structure 800 which are released as a unit from the valve structure 500. The valve structure 500 may be removed or remain intact.

The valve removal tool 600 is now ready to be used for the installation of another sensor plug 100 following the installation procedure as described above.

In some cases a valve removal plug and a blind flange may be installed in a passage 9, when the sensor plug 100 is to be installed. In such cases the valve removal plug and the blind flange are removed before the installation of the sensor plug 100 in accordance with the method as described above.

Initially the pressure integrity of the valve removal plug needs to be verified, and the blind flange is removed. The valve structure 500 such as for instance a gate valve is mounted to the well head as described in connection with installing the valve structure as shown in FIG. 5*a*. The support structure 400 for a valve removal tool 600 is connected to the valve structure 500 by connecting means 60, similar to the procedure for doing this as described in connection with FIG. 5*a*. A socket to fit with the valve removal plug installed in the passage 9 is mounted on the valve removal tool 600. The valve removal tool 600 is thereafter connected to the support structure 500 in a sealed manner to ensure a leakage free connection (the connection means are not shown) between the valve removal tool 600 and the support structure 500. In this position the valve removal tool 600 with the socket for the valve removal plug is located in a portion of the through bore 501 similar to the position as shown in FIG. 5*c*. A pressure test is then performed with the valve element 502 in its closed position and to check for possible leakage. The pressure is then bled down to a pressure essentially equalizing the pressure of the annulus in communication with the passage 9. The movable valve element 502 is then brought to an open position.

The movable unit 602 of the valve removal tool 600 is displaced into the through bore 501, here illustrated by the movable unit 602 comprising telescoping tool parts 603, 604 bringing the socket for the valve removal plug (not shown) into engagement with the valve removal plug (not shown), similar to the position as shown in FIG. 5*b*. The valve removal plug is released from passage 9, by screwing the valve removal plug out from the passage. The movable unit 602 is then returned through the through bore 501 with the valve removal plug attached to the valve removal plug socket, similar to the position as shown in FIG. 5*a*. The movable valve element 502 is then brought to a closed position and the pressure of structure 500 is bled off. The valve removal tool 600 with the valve removal plug attached to the valve removal plug socket is then released from the support structure 400, and the valve removal plug socket is free to be removed from the valve removal plug socket. Alternatively, the valve removal tool 600 and the support structure 400 comprise a valve removal tool structure 800 which are released as a unit from the valve structure 500.

The valve removal tool 600 is now ready to be used for the installation of a sensor plug 100 following the installation procedure as described above.

The invention claimed is:

1. A method for installing an apparatus for monitoring physical parameters in an annulus of an oil and/or gas well having a well head, which apparatus comprises a sensor plug including a sensor arranged inside the sensor plug, and a flange assembly arranged with a bore holding a signal processing unit for communication with the sensor, wherein the method comprises the following steps;

installing the sensor plug including the sensor in a passage in the well head, which passage communicates with an annulus of the well, connecting a cable connector to the sensor plug, which cable connector is attached to an end of a cable, connecting the sensor of the sensor plug to the signal processing unit in the bore of the flange assembly, positioning the bore of the flange assembly essentially coinciding with the passage of the well head thereby inserting the cable connector into the bore and attaching the flange assembly to the well head thereby.

2. A method for installing an apparatus for monitoring physical parameters in an annulus of an oil and/or gas well in accordance with claim 1, wherein the step of installing the sensor plug including the sensor in a passage in the well head, further comprises the following steps;

connecting a valve removal tool structure, having a valve removal tool holding the sensor plug, to a valve structure having an open and a closed position, which valve structure has been premounted to the well head and is arranged for communication with the passage in the well head, and the valve structure is arranged in the closed position, bringing the valve structure into its open position and inserting the sensor plug through the valve structure and into the passage of the well head using the valve removal tool.

3. A method for installing an apparatus for monitoring physical parameters in an annulus of an oil and/or gas well in accordance with claim 2, wherein prior to bringing the valve structure into its open position and inserting the sensor plug through the valve structure and into the passage of the well head using the valve removal tool:

pressure testing the valve structure in its closed position, bleeding down the pressure of the valve structure to a pressure essentially close to annulus pressure, and wherein further the step of inserting the sensor plug through the valve structure and into the passage of the well head using the valve removal tool structure in accordance with claim 2 comprises the following steps:

displacing a movable unit of the valve removal tool structure thereby inserting the sensor plug through the valve structure and into the passage of the well head, detaching the sensor plug from the valve removal tool.

4. A method for installing an apparatus for monitoring physical parameters in an annulus of an oil and/or gas well in accordance with claim 3, and thereafter carrying out the following steps:

pressure testing the sensor plug, bleeding off pressure in the valve structure, removing the valve removal tool structure, closing the valve structure, removing the valve structure.

5. A method for installing an apparatus for monitoring physical parameters in an annulus of an oil and/or gas well in accordance with claim 2, further comprising the steps of, attaching a support structure for the valve removal tool to the valve structure, attaching the valve removal tool to the connecting structure.

6. A method for installing an apparatus in accordance with claim 1, wherein the method further comprises the step of carrying out a pressure test of the flange assembly by introducing a fluid into at least one flow passage mouthing into the bore of the flange assembly pressurizing the fluid filling the bore of the flange assembly.

7. A method for installing an apparatus in accordance with claim 1, wherein the method further comprises connecting a control cable to the signal processing unit of the flange assembly through an opening in the wall of the flange assembly.

8. A method for installing an apparatus in accordance with claim 1, wherein the method further comprises mounting an antenna in an opening in the wall of the flange assembly, which antenna communicates wirelessly with the signal processing unit in the flange assembly.

9. Method for retrieving an apparatus for monitoring physical parameters in an annulus of an oil and/or gas well having a well head, which apparatus comprises a sensor plug including a sensor and a flange assembly arranged with a bore holding a signal processing unit for communication with the plug sensor installed in a passage of a well head and which passage communicates with an annulus of the well, wherein the method comprises the following steps;

disconnecting a control cable or optionally remove battery in connection with the signal processing unit of the flange assembly, removing the flange assembly from engagement with the well head, disconnecting a cable connector attached to the sensor plug, which cable connector is attached to an end of a cable connecting the sensor of the sensor plug to the signal processing unit in the bore of the flange assembly, connecting a valve structure to the well head in communication with the passage in the well head, which valve structure has an open and a closed position, removing the sensor plug through the valve structure in an open position using a valve removal tool structure.

10. Method for retrieving an apparatus for monitoring physical parameters in an annulus of an oil and/or gas well having a well head in accordance with claim 9;

wherein the step of removing the sensor plug through the valve structure in an open position using a valve removal tool structure, further comprises the following steps connecting the valve removal tool structure to the valve structure in its closed position, which valve removal tool structure has a valve removal tool provided with a socket for the sensor plug, opening the valve structure and displacing a movable unit of the valve removal tool structure through the valve structure to engage the socket with the sensor plug in the passage of the well head, removing the sensor plug by retracting the movable unit of the valve removal tool structure through the valve structure in its open position.

11. Method for retrieving an apparatus for monitoring physical parameters in an annulus of an oil and/or gas well having a well head in accordance with claim 10, wherein the method further comprises the following steps;

closing the valve structure, bleeding off pressure of the valve structure, removing the valve removal tool structure from the valve structure.

12. Method for retrieving an apparatus for monitoring physical parameters in an annulus of an oil and/or gas well having a well head in accordance with claim 11, wherein the valve removal tool structure comprises a connecting structure for the valve removal tool attached to the valve structure and the valve removal tool is connected to the connecting structure, and in carrying out the step of removing the valve removal tool structure from the valve structure, detaching the valve removal tool from the connecting structure, detaching the connecting structure from the valve structure.

13. Method for retrieving an apparatus for monitoring physical parameters in an annulus of an oil and/or gas well in accordance with claim 10, further comprising the following steps:

attaching a connecting structure for the valve removal tool to the valve structure, attaching the valve removal tool to the connecting structure.

* * * * *